US005085127A

United States Patent [19]

Gantzer

[11] Patent Number: 5,085,127

[45] Date of Patent: Feb. 4, 1992

[54] CAVITATION RESISTANT HYDRAULIC CYLINDER BLOCK PORTING FACES

[75] Inventor: Charles J. Gantzer, South Beloit, Ill.

[73] Assignee: Sundstrand Corporation, Rockford, Ill.

[21] Appl. No.: 502,167

[22] Filed: Mar. 29, 1990

[51] Int. Cl.[5] ..... F01B 13/04

[52] U.S. Cl. ..... 91/499; 417/269

[58] Field of Search ..... 91/499; 417/269

[56] References Cited

U.S. PATENT DOCUMENTS

| | | | |
|---|---|---|---|
| Re. 32,197 | 7/1986 | Self | 137/625.3 |
| 3,080,854 | 3/1963 | Wiggermann . | |
| 3,169,488 | 2/1965 | Galliger . | |
| 3,180,275 | 4/1965 | Boulet . | |
| 3,204,570 | 9/1965 | Firth et al. . | |
| 3,280,758 | 10/1966 | Leeming et al. . | |
| 3,292,553 | 12/1966 | Hann . | |
| 3,382,793 | 5/1968 | Gantzer . | |
| 3,407,744 | 10/1968 | Slimm . | |
| 3,487,788 | 1/1970 | Thoma et al. . | |
| 3,585,901 | 6/1971 | Moon, Jr. et al. . | |
| 3,611,876 | 10/1971 | Day . | |
| 3,707,034 | 12/1972 | Alger, Jr. et al. . | |
| 3,709,107 | 1/1973 | Alger, Jr. et al. . | |
| 3,768,378 | 10/1973 | Adams et al. . | |
| 3,803,687 | 4/1974 | Alger, Jr. et al. . | |
| 3,954,124 | 5/1976 | Self | 137/625.3 |
| 4,437,389 | 3/1984 | Kline . | |
| 4,550,645 | 11/1985 | Beck, Jr. . | |
| 4,799,419 | 1/1989 | Krause . | |

*Primary Examiner*—Gerald A. Michalsky
*Attorney, Agent, or Firm*—Wood, Phillips, Mason, Recktenwald & Vansanten

[57] ABSTRACT

A problem with hydraulic displacement units of the axial piston type is the cavitation which occurs at the porting face of the cylinder block due to the conventional use of a bearing material which, because of its very nature, has a tendency to erode. A solution to this problem is provided by a hydraulic axial displacement pump or motor which comprises a housing (10), a rotatable cylinder block (18) in the housing (10) and including a plurality of bores (30), a piston (35) in each of the bores (30) and reciprocable therein upon rotation of the cylinder block (18), a valve member (12) having inlet and outlet ports (34) and in abutment with the cylinder block (18) wherein each of the bores (30) has a port (31) opening to the ports (34) in the valve member (12) to establish fluid communication therewith, and a porting face (63) on the cylinder block (18) about the ports to the bores (30) and abutting the valve member or endcap (12) formed of a hard, erosion resistant material, and at least one stabilization foot (65) extending from the cylinder block (18) toward the valve member (12) and formed of a bearing material. This configuration results in a pump or motor which avoids cavitation caused erosion in the porting face which in turn results in a longer life and more efficient operation of the pump or motor.

11 Claims, 2 Drawing Sheets

CAVITATION RESISTANT HYDRAULIC CYLINDER BLOCK PORTING FACES

FIELD OF THE INVENTION

This invention relates generally to hydraulic energy translating devices and more particularly to an axial piston hydraulic pump or motor.

BACKGROUND OF THE INVENTION

One type of axial piston hydraulic unit conventionally employs a rotary cylinder block including a plurality of axial bores or cylinders having a plurality of axially disposed pistons reciprocable in the block. A relatively stationary valve member having inlet and outlet ports engages one end of the rotating cylinder block so that the cylinders in the block serially communicate with the inlet and outlet ports as the block rotates. In such devices the pistons may have spherical ends carrying pivotal slippers which engage an angular cam or swashplate so that the pistons reciprocate in the cylinder block.

When the hydraulic unit acts as a pump, the block is rotated and fluid is drawn into the cylinder through the inlet port as the pistons withdraw away therefrom the bores. Piston return mechanisms are usually provided for withdrawing the pistons through the intake stroke and for maintaining engagement between the slippers and the cam. As the pistons pass over top dead center they begin movement into the cylinders, discharging high pressure fluid through the outlet ports in the valve member. When the device operates as a motor, the reverse operation occurs, with high pressure fluid entering the inlet port forcing the pistons out of the cylinders thereby effecting rotation of the cylinder block.

In recent years hydraulic component applications in various industries have become increasingly taxing. For example axial piston pumps and motors are being required to far exceed their original design capabilities and increases in both hydraulic pressure and rotational speeds are causing higher rates of failure in axial piston pumps and motors.

One of the areas which is more failure prone is the interface between the rotating barrel or cylinder block and the valve member. A good seal is required between the two, and to keep such a seal, two requirements must be met: first, the mating surfaces must be extremely flat and perfectly parallel and secondly, proper axial alignment between the barrel or cylinder block and the valve member must be maintained. If the two are slightly axially misaligned i.e. relative to one another, increased wear of the mating surfaces on the cylinder block and valve member will occur, leading to premature failure. Also misalignment may cause excessive leakage, which effects efficiency and disturbs the hydrostatic balance of the cylinder block.

In the areas of the porting faces formed by the cylinder block, the porting faces being that area of the cylinder block which abuts the valve member so as to provide a passage between the cylinders and the inlet and outlet ports of the valve member, varying types of bearing materials, such as bronzes, are usually employed. Bearing materials are those having favorable characteristics in the categories of conformability, embedability, wear resistance, abrading tendency and corrosion resistance. The bearing material provides, ultimately, sliding friction characteristics favorable for operation.

In some applications, the entire block is made out of a bearing material while others use a composite of steels in the high stress areas and bearing material in the bearing areas such as in block bores and the porting faces. Common to all of these is the fact that a bearing type material is normally used on the port face. However, use of the bearing type material provides problems in that a too soft bearing material tends to erode as a result of cavitation at or around the porting face. Further coupled with this problem is the fact that a misalignment may occur due to the cavitation caused erosion, thus increasing the chance of unit breakdown. Erosion and cavitation also adversely effects the balance and efficiency of a unit.

The present invention is directed to providing an axial hydraulic displacement unit which overcomes one or more of the above problems.

DETAILED DESCRIPTION OF THE INVENTION

Figure 1:
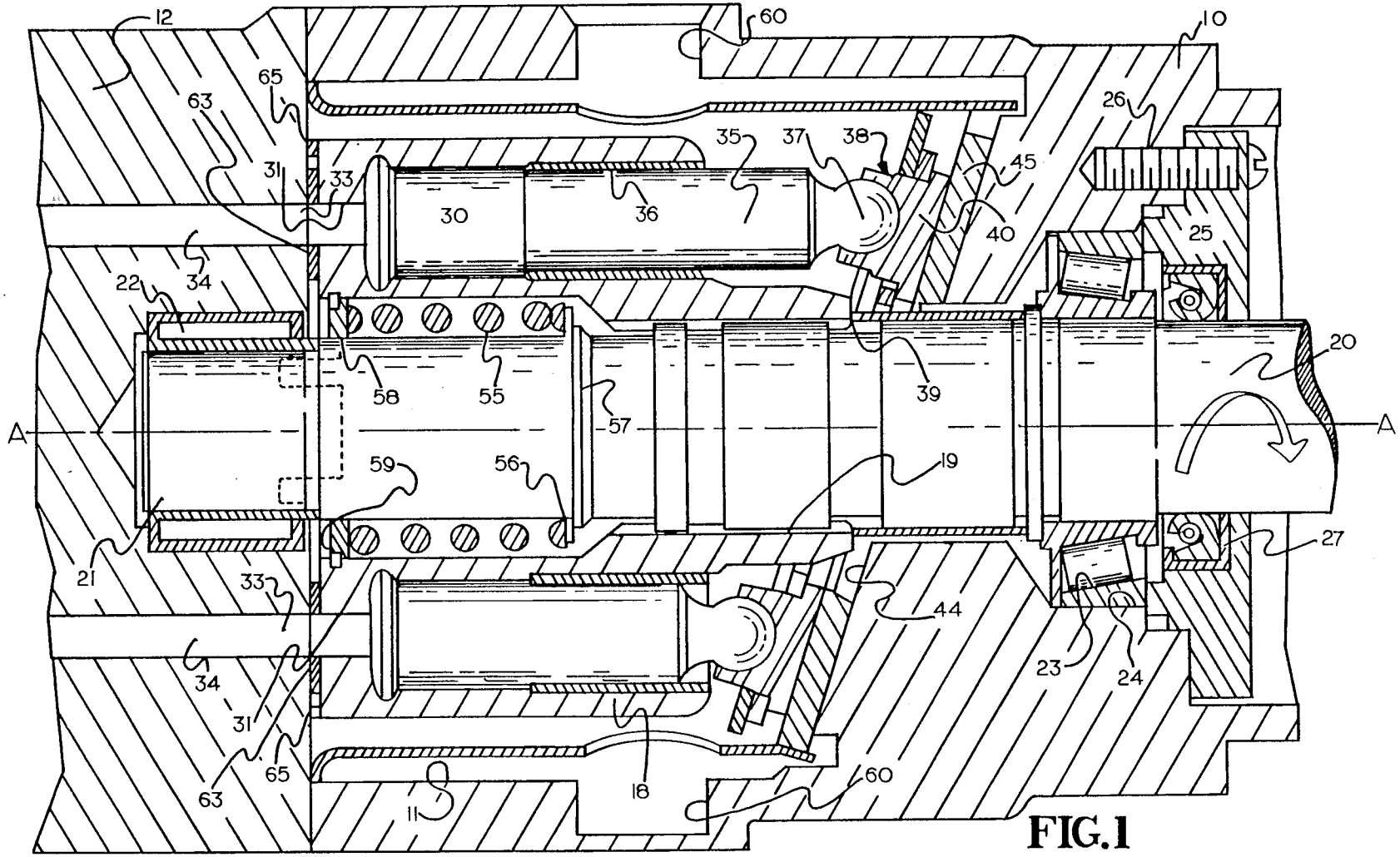
FIG. 1 illustrates through a cross-sectional view the basic components of a hydraulic displacement unit of the axial piston fixed displacement type.

The structure as shown in FIG. 1 is typical of a hydraulic displacement unit which is of the axial piston type and which may be used as either a pump or a motor. The unit has a housing 10 with a cavity 11 closed by a valve member or end cap 12 shown at a 90° rotation out of proper position. The housing 10 and the end cap 12 can be attached by any means including bolts (not shown).

A rotatable cylinder block 18 is positioned within the housing cavity 11 and has an internal bore splined at 19 to a rotatable shaft 20 defining a block center line, A—A, and which can be a driven shaft when the hydraulic displacement unit is to operate as a pump or a drive shaft when the unit is operating as a motor. The shaft 20 has a reduced diameter end 21 rotatably supported in a bearing 22 in the end cap 12. A thrust bearing 23 mounted in a recess 24 in the housing 10 also rotatably supports and axially locates the shaft 20 with the bearing 23 being held in the recess 24 by a plate 25 secured to the housing end by fastening means such as bolt 26. A seal 27 surrounds the shaft 20 and seals the interior of the housing cavity.

The cylinder block 18 has a series of axial piston bores or chambers 30 spaced about the axis of rotation of the shaft 20, each of which has an opening or port 31 to the end cap 12 having an inlet and outlet 33, conventionally kidney shaped. The end cap 12 has inlet and outlet ports 34, also conventionally kidney shaped, which align with the chamber openings 31. The ports 34 connect successively with the piston chamber openings 31 as the cylinder block 18 rotates relative to the end cap 12 and these ports 34 communicate with a fluid passage in the end cap 12.

Each of the piston chambers 30 has a piston 35 reciprocal therein within an optional sleeve bearing 36. The pistons 35 can be of a conventional construction, with a spherical end 37 rockably mounted mounting a slipper, indicated generally at 38. The slipper 38 has spherical recesses 39 to receive the spherical ends 37 of the pistons and a slipper foot 40 is engageable with a swash surface which controls the reciprocal moving of the pistons.

The swash surface can be formed integrally with the housing 10 or defined by a fixed or movable member positioned within the housing 10. As shown, the housing cavity 11 has an inclined end wall 44 provided with a counter bore into which a thrust plate 45 is mounted defining the swash surface engaged by the slipper feet 40.

The cylinder block 18 is firmly pressed against the end cap 12 by a compression spring 55 interposed between a ring 56 abutting a shoulder 57 on the shaft 20 and a ring 58 fixed to the cylinder block 18 by an annular spring clip 59 and by the hydraulic balance. The housing 10 has radial passages 60 through the wall thereof providing for draining of oil from the housing cavity 11.

The cylinder block 18 is in contact with the end cap 12 at porting faces 63 which surround and define the conventionally kidney shaped chamber outlets 33. Further the cylinder block 18 also contacts the end cap 12 at a peripheral stabilization foot 65 located toward the outside diameter of the cylinder block 18 and which serves to maintain the cylinder block 18 in alignment with the end cap 12 by avoiding tipping of the cylinder block 18 that would otherwise occur as a result of canting forces occurring by reason of the angular position of the thrust plate 45 and the centrifugal force of the piston assemblies. The stabilization foot 65 normally is designed to allow for draining any leaking oil from the seal face. Normally the foot 65 will have 6 or more radial slots (not shown) for such drainage.

Figure 2:
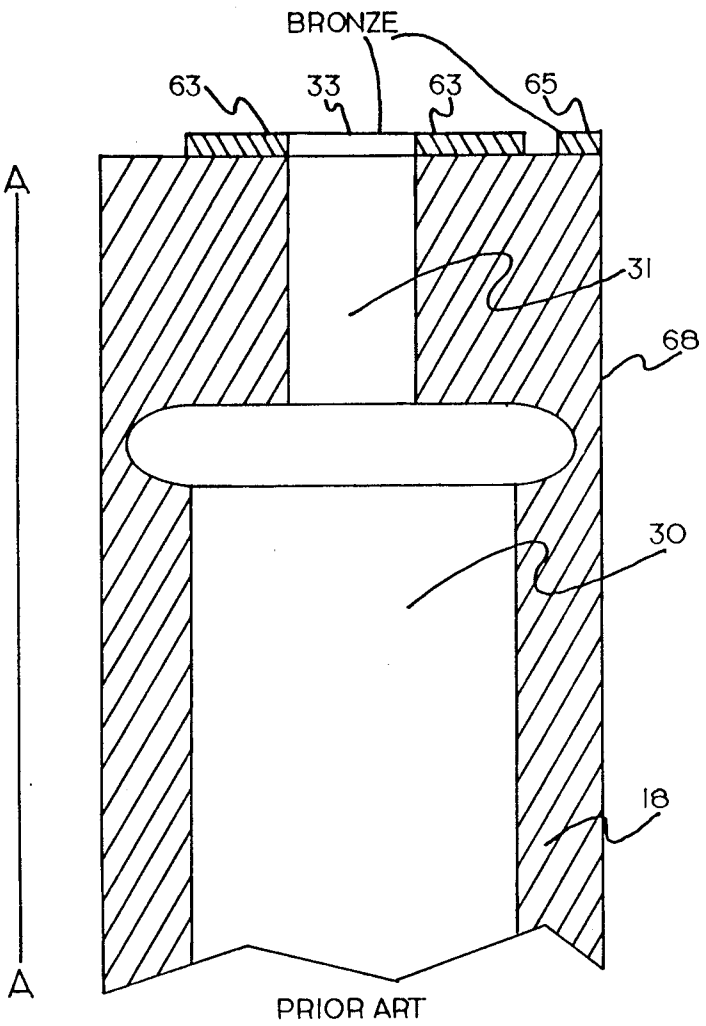
PRIOR ART FIG.2
FIG. 2 is a fragmentary sectional view illustrating prior art configuration of the porting face area.

Turning now to FIG. 2, which is prior art, and in which like reference numerals are used for like items found in FIG. 1, shown is a cylinder block 18 with an outer diameter 68 and including the piston chamber 30, which includes a chamber opening 31 and a kidney shaped cylinder outlet 33. Further, the cylinder block 18 includes a porting face 63 surrounding each of the cylinder ports 31 and a stabilization foot 65. In the prior art the stabilization foot 65 and the porting faces 63 made out of bearing type materials such as bronze metal to aid in operation of the hydraulic displacement unit. However, it has been found that with more demanding operating conditions such as increased temperatures, pressures and speeds, the soft bearing materials used for the porting faces tends to erode from cavitation at and around the cylinder ports 31.

Figure 3:
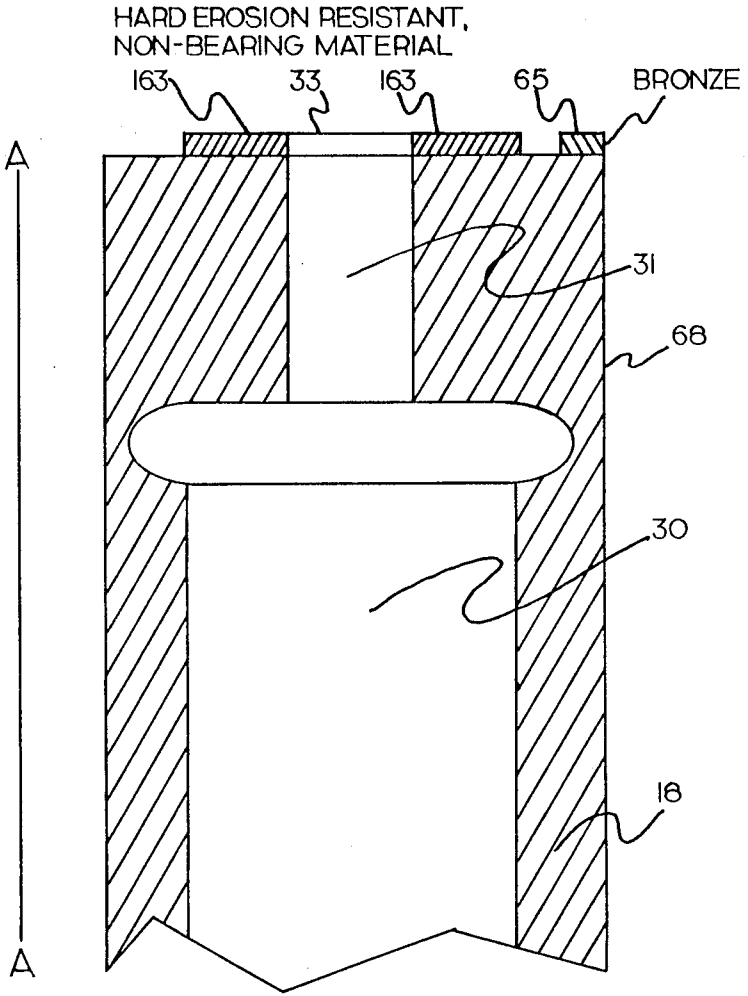
FIG. 3 is a fragmentary sectional view of a hydraulic displacement unit's porting face area per the invention.

FIG. 3 shows a solution to the cavitation problem. The cylinder block 18 includes a piston chamber 30 having a cylinder port 31 and a kidney shaped cylinder porting outlet 33. Also on the cylinder block are porting faces 163 surrounding each cylinder port 31 and a stabilization foot 65.

Each porting face 163 is made out of a hard, erosion resistant material characterized by an absence of bearing material. The material may be integral with the cylinder block 18 or formed separately and bonded to the cylinder block 18.

The porting face 163 should be made of a material having a Rockwell hardness (HRC) of generally at least fifty eight (58) which will provide the necessary characteristics to withstand cavitation. A group of such materials would be graphitic tool steels and include AISI A-10, AISI 0-6, and other similar steels, although other tool steels may be used. These steels have the necessary hardness to resist cavitation. The A-10 steels are air hardened and when hardened provide little or no distortion during heat treatment. The 0-6 steels are oil hardened and may have more favorable wear characteristics depending upon the material of the end cap 12.

The stabilization foot 65 is made out of bearing material and is preferably bronze. The stabilization foot 65 may be separately formed and later bonded to the cylinder block 18. The stabilization foot serves to prevent tipping and misalignment of the cylinder block 18 as in the prior art so that the hydraulic displacement unit will have a longer life and operation of the unit will be more efficient with less down time due to cavitation problems.

It should be noted that the bonding requirement of the bronze foot to the cylinder block does not require as high quality bond as in the kidney area of the blocks as the foot is not exposed to the high pressure pulsing as seen in the port kidney area. The used of AISI A-10 or 0-6 may in some applications eliminate the need for the block bore bushing or sleeve bearing 36. This design could be used with the current practice of using AISI A-7, but would most likely require the use of the block bushing or sleeve bearing 36. This design is applicable to wrought blocks as well as those made from power metallurgy (P/M).

I claim:

1. A hydraulic axial displacement pump or motor comprising:

a housing;

a rotatable cylinder block in said housing and including a plurality of bores;

a piston in each of said bores and reciprocable therein upon rotation of said cylinder block;

a valve member having inlet and outlet ports and in abutment with said cylinder block;

each of said bores having a port opening to said ports in said valve member to establish fluid communication therewith;

a raised porting face on said cylinder block about each of the ports to said bores and abutting said valve member, said porting face being formed of a hard, erosion resistant material and further characterized by an absence of bearing material; and at least one stabilization foot extending from said cylinder block toward said valve member and formed of bearing material.

2. A hydraulic axial displacement pump or motor as recited in claim 1 wherein said stabilization foot is formed of bronze.

3. A hydraulic axial displacement pump or motor as recited in claim 1 wherein the hard erosion resistant material has a HRC number of generally at least 58.

4. A hydraulic axial displacement pump or motor as recited in claim 3 wherein the hard erosion resistant material is a graphitic tool steel or other tool steel.

5. A hydraulic axial displacement pump or motor as recited in claim 4 wherein said graphitic tool steel is one selected from the group consisting of AISI A-10, AISI 0-6 and similar steels.

6. A hydraulic axial displacement pump or motor comprising:

a housing;

a rotatable cylinder block in said housing and including a plurality of bores;

a piston in each of said bores and reciprocable therein upon rotation of said cylinder block;

a valve member having inlet and outlet ports and in abutment with said cylinder block;

each of said bores having a kidney-shaped port opening to said ports in said valve member to establish fluid communication therewith;

a raised porting face on said cylinder block about the ports to said bores and abutting said valve member, said porting face being formed of a hard, erosion resistant material having an HRC number of at least 58; and at least one stabilization foot extending from said cylinder block toward said valve member and formed of bronze.

7. The hydraulic axial displacement pump or motor as recited in claim 5 wherein said hard erosion resistant material is a graphitic tool steel.

8. The hydraulic axial displacement pump or motor as recited in claim 7 wherein said graphitic tool steel is selected from the group consisting of AISI A-10 and AISI 0–6.

9. A hydraulic axial displacement pump or motor comprising:

a housing;

a rotatable cylinder block in said housing and including a plurality of bores;

a piston in each of said bores and reciprocable therein upon rotation of said cylinder block;

a valve member having inlet and outlet ports and in abutment with said cylinder block;

each of said bores having a port opening to said valve member ports to establish fluid communication therewith;

porting faces on said cylinder block about the ports to said bores and abutting said valve member, said porting faces being formed of a hard erosion resistant material that resists cavitation caused erosion, said hard, erosion resistant material having a HRC number of generally at least 58; and at least one stabilization foot extending from said cylinder block towards said valve member and formed out of bearing material.

10. The hydraulic axial displacement pump or motor as recited in claim 9 wherein the hard, erosion resistant material is a graphitic tool steel.

11. The hydraulic axial displacement pump or motor as recited in claim 10 wherein said graphitic tool steel is one selected from the group consisting of AISI A-10 and AISI 0–6 steels.

* * * * *